US011780722B1

(12) United States Patent
Wantland et al.

(10) Patent No.: US 11,780,722 B1
(45) Date of Patent: Oct. 10, 2023

(54) AUTOFILL PITCHER OVERFILL SHUTOFF MECHANISM

(71) Applicant: Haier US Appliance Solutions, Inc., Wilmington, DE (US)

(72) Inventors: Louis A. Wantland, Louisville, KY (US); Lokesha Kodigenhalli Chinnappa Reddy, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/965,974

(22) Filed: Oct. 14, 2022

(51) Int. Cl.
*B67D 1/12* (2006.01)
*B67D 1/00* (2006.01)
*F25D 23/12* (2006.01)

(52) U.S. Cl.
CPC ..... *B67D 1/1238* (2013.01); *B67D 1/0014* (2013.01); *F25D 23/126* (2013.01); *B67D 2001/1263* (2013.01)

(58) Field of Classification Search
CPC ..... B67D 7/02; B67D 7/002; B67D 7/362; B67D 7/365; B67D 1/0014; B67D 1/1238; F25D 23/126
USPC ..... 62/389
See application file for complete search history.

(56) References Cited

U.S. PATENT DOCUMENTS

| | | | | |
|---|---|---|---|---|
| 5,294,917 | A * | 3/1994 | Wilkins | B67D 7/365 73/317 |
| 6,681,585 | B1 * | 1/2004 | Stagg | F25D 23/126 62/177 |
| 7,810,345 | B2 * | 10/2010 | Nebbia | F25D 23/126 62/338 |
| 8,302,412 | B2 * | 11/2012 | Tieleman | C02F 3/1263 62/272 |
| 8,607,583 | B2 * | 12/2013 | Morgan | B01D 5/009 62/272 |
| 9,085,453 | B2 * | 7/2015 | McMahan | F25D 23/126 |
| 9,663,343 | B2 * | 5/2017 | Veldhi | B67D 3/0093 |
| 9,890,029 | B2 * | 2/2018 | Comsa | B67D 1/1238 |
| 10,077,183 | B2 * | 9/2018 | McMahan | F25D 23/04 |
| 10,519,025 | B2 | 12/2019 | Sakthivel et al. | |
| 10,794,628 | B2 * | 10/2020 | Park | F25D 23/028 |
| 11,619,439 | B2 * | 4/2023 | Kwon | F25D 23/06 62/4 |
| 2015/0197417 | A1 * | 7/2015 | Stagg | B67D 1/0003 141/95 |
| 2015/0355014 | A1 * | 12/2015 | Deak | G01F 23/62 73/313 |
| 2017/0074714 | A1 * | 3/2017 | Aschenbrenner | G01F 25/20 |

* cited by examiner

*Primary Examiner* — Timothy L Maust
(74) *Attorney, Agent, or Firm* — Dority & Manning, P.A.

(57) ABSTRACT

An autofill pitcher system is provided that includes a removable pitcher, a dispenser, and a controller. The removable pitcher includes a magnet supported for rotation between a first position and a second position. The controller is configured to open a valve in the dispenser to direct water to the pitcher when a sensor in the dispenser detects the magnet and close the valve when the sensor does not detect the magnet.

18 Claims, 8 Drawing Sheets

AUTOFILL PITCHER OVERFILL SHUTOFF MECHANISM

FIELD OF THE INVENTION

The present subject matter relates generally to refrigerator appliances, and more particularly to autofill water dispensing systems for refrigerator appliances.

BACKGROUND OF THE INVENTION

Some refrigerator appliances include autofill dispensing systems. Autofill dispensing systems typically include a dispensing housing and a pitcher. When the pitcher is positioned in a designated spot, e.g., beneath the autofill housing, water or another liquid is automatically dispensed into the pitcher. Some autofill dispensing systems include a pitcher present sensor in the dispensing housing and a trigger device in the pitcher to determine when the pitcher is in the correct position to accept the dispensed liquid. In addition to the pitcher present sensor, some autofill pitchers include a pitcher full sensor including a float mechanism positioned within a housing of the pitcher that moves upward with the rising liquid in the autofill pitcher. When the liquid within the autofill pitcher has reached a designated fill level, the float mechanism triggers the system to cease dispensing liquid.

In some situations, float mechanisms may fail due to manufacturing defects, deposits from the water or water additives introduced by users into the pitcher that build up and interfere with the proper operation of the float mechanism. A pitcher full sensor that is more robust against contamination would be beneficial. Additionally or alternatively, a redundant sensor to prevent a pitcher over-fill condition may be beneficial. However, a redundant sensor would take up additional space in the pitcher, thereby reducing pitcher volume, or add to the overall size of the pitcher.

Accordingly, an autofill dispensing system in a refrigerator that addresses one or more of the challenges noted above would be desirable.

BRIEF DESCRIPTION OF THE INVENTION

Aspects and advantages of the invention will be set forth in part in the following description, may be apparent from the description, or may be learned through practice of the invention.

In one exemplary aspect, a refrigerator appliance comprising a cabinet defining a fresh food chamber and an autofill pitcher system is provided. The autofill pitcher system comprises a removable pitcher having a pitcher wall connected to a pitcher bottom to define a volume, the pitcher wall defining an opening at a top edge of the removable pitcher. The pitcher also comprises a first magnet fixed to a first end of a pivot arm, the pivot arm pinned for rotation between a first position and a second position. The autofill pitcher system further comprises a dispenser defining a cavity within the fresh food chamber to receive the removable pitcher. The dispenser comprises a first sensor, a fill tube adapted to direct water from a water supply to the removable pitcher, a valve couple to the fill tube, and a controller. The controller is configured to open the valve when the first sensor detects the first magnet when the pivot arm is in the first position and close the valve when the first sensor does not detect the first magnet in the second position.

In another exemplary aspect, an autofill pitcher system comprises a removable pitcher having a pitcher wall connected to a pitcher bottom to define a volume, the pitcher wall defining an opening at a top edge of the removable pitcher. The pitcher also comprises a first magnet fixed to a first end of a pivot arm, the pivot arm pinned for rotation between a first position and a second position. The autofill pitcher system further comprises a dispenser defining a cavity to receive the removable pitcher. The dispenser comprises a first sensor, a fill tube adapted to direct water from a water supply to the removable pitcher, a valve couple to the fill tube, and a controller. The controller is configured to open the valve when the first sensor detects the first magnet when the pivot arm is in the first position and close the valve when the first sensor does not detect the first magnet in the second position.

In still another exemplary aspect, an autofill pitcher system comprises a removable pitcher having a pitcher wall connected to a pitcher bottom to define a volume, the pitcher wall defining an opening at a top edge of the removable pitcher. The pitcher further comprises a first magnet fixed to a first end of a pivot arm, the pivot arm pinned for rotation between a first position and a second position, and a second magnet. The dispenser defines a cavity to receive the removable pitcher, the dispenser comprising a first sensor, a second sensor, a fill tube adapted to direct water from a water supply to the removable pitcher, and a valve coupled to the fill tube. A pitcher present signal is sent to a controller when the first sensor detects the first magnet and the controller sends a signal to open the valve when the second sensor does not detect the second magnet.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
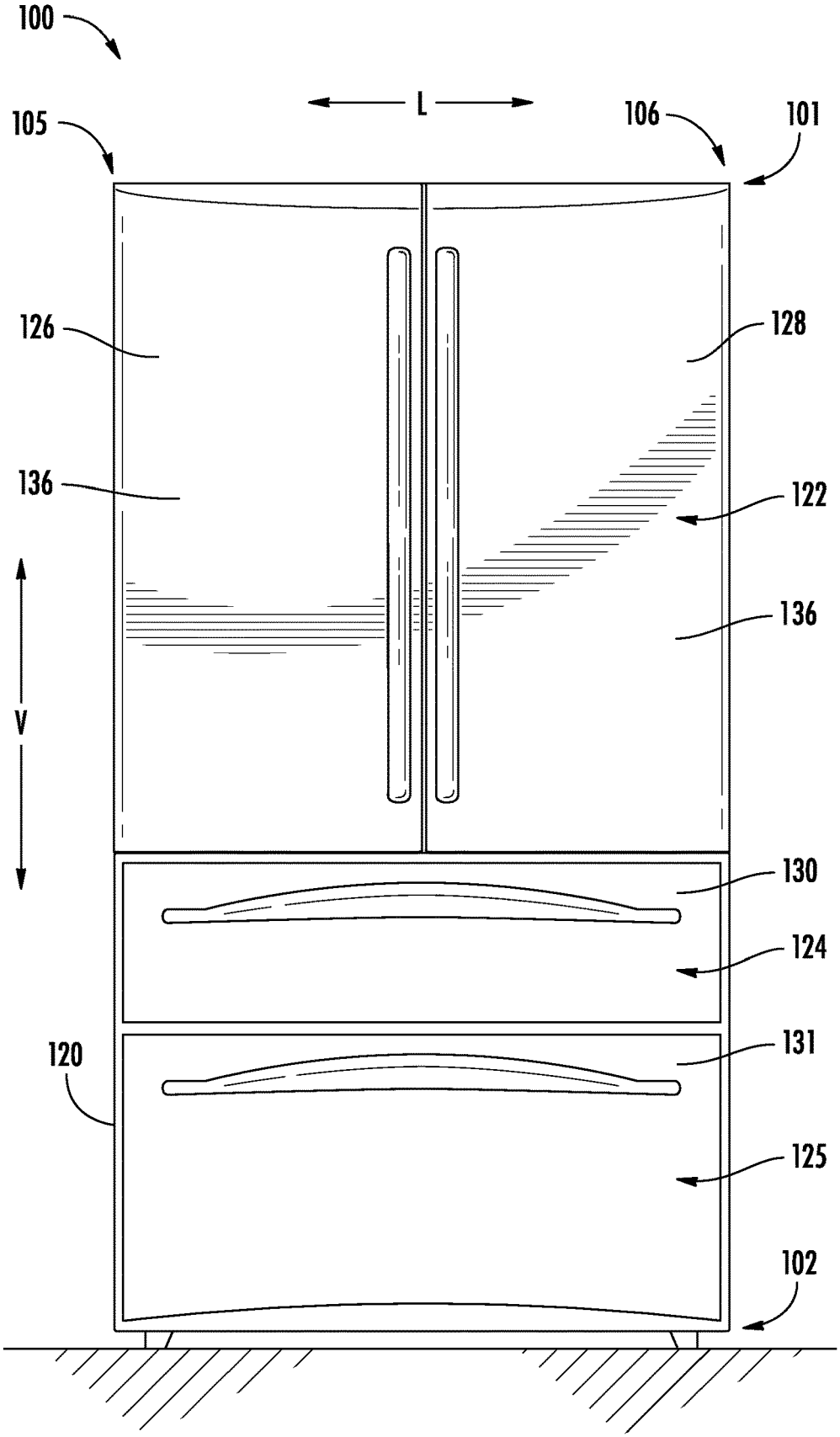
FIG. 1 provides a front view of a refrigerator appliance according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Turning to the figures, FIG. 1 provides a front view of an exemplary refrigerator appliance 100 according to an exemplary embodiment of the present disclosure. Refrigerator appliance 100 extends between a top 101 and a bottom 102 along a vertical direction V, between a left side 105 and a right side 106 along a lateral direction L, and extends between a front and a back along a transverse direction T (not shown), which is a direction orthogonal to the vertical direction V and the lateral direction L. Vertical direction V, lateral direction L, and transverse direction T are mutually perpendicular and form an orthogonal direction system.

Refrigerator appliance 100 includes a housing or cabinet 120 defining a chilled chamber, fresh food chamber 122, and one or more freezer chambers, such as a first freezer chamber 124 and a second freezer chamber 125, which may both be arranged below fresh food chamber 122 along the vertical direction V. As illustrated, fresh food chamber 122 is bounded by vertical walls at the left side 105 and at the right side 106, such walls spaced apart in the lateral direction, a horizontal wall at the top 101 and at the bottom by a lower wall 132. In this configuration, refrigerator appliance 100 may generally be referred to as a bottom mount, or bottom freezer, refrigerator. Cabinet 120 also defines a mechanical compartment (not shown) for receipt of a sealed cooling system (not shown).

Left and right refrigerator doors 126, 128, respectively, are rotatably hinged to an edge of cabinet 120 at left 105 and right 106 sides, respectively, for accessing fresh food chamber 122 (FIG. 2) or sealing fresh food chamber 122 as illustrated in FIG. 1. For example, upper and lower hinges may couple each door 126, 128 to cabinet 120. When left and right doors 126, 128 are configured as illustrated in FIG. 1, the door arrangement is sometimes referred to as a "French door" configuration. Freezer doors, such as a first freezer door 130 and a second freezer door 131, may be arranged below refrigerator doors 126, 128 for accessing one or more freezer chambers, such as first and second freezer chambers 124, 125, respectively. In the exemplary embodiment shown in FIG. 1, freezer doors 130, 131 are coupled to freezer drawers (not shown) slid ably coupled within first and second freezer chambers 124, 125. Such drawers are thus generally "pull-out" drawers in that they can be manually moved into and out of freezer chambers 124, 125 on suitable slide mechanisms. Each door 126, 128, 130, 131 can include a handle for accessing one of the chambers 122, 124, 125 of refrigerator appliance 100.

Figure 2:
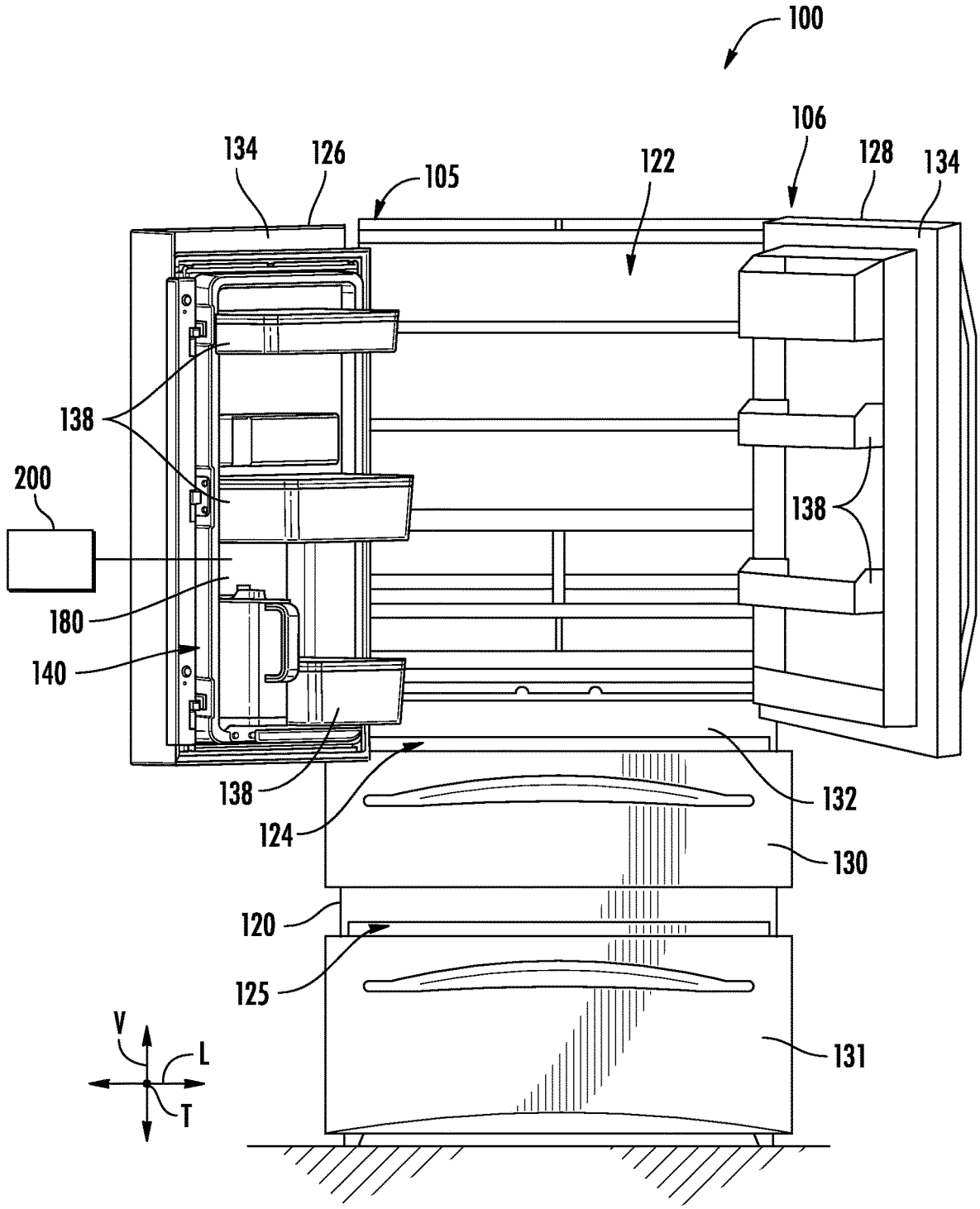
FIG. 2 provides a front view of the refrigerator appliance of FIG. 1 with refrigerator doors shown in an open configuration.

FIG. 2 provides a front perspective view of refrigerator appliance 100 showing refrigerator doors 126, 128 in an open position to reveal the interior of fresh food chamber 122. Additionally, freezer doors 130, 131 are shown in partially open positions to reveal a portion of the interior of freezer chambers 124, 125, respectively.

Left door 126 of refrigerator appliance 100 includes an inner surface 134 and an outer surface 136. Inner surface 134 generally defines a portion of the interior of fresh food chamber 122 when door 126 is in a closed position as shown in FIG. 1. Outer surface 136 is generally opposite inner surface 134 and defines a portion of the exterior of refrigerator appliance 100 when door 126 is in the closed position.

The same construction may result in a similarly formed right door 128 as left door 126 with inner surface 134 and outer surface 136. Moreover, it will further be appreciated that freezer doors 130, 131 can likewise include inner and outer surfaces.

Doors 126, 128 may include storage bins or shelves 138 movably or fixedly attached to the inner surface 134 of the doors 126, 128. In the embodiment illustrated in FIG. 2, left door 126 includes an autofill pitcher system 140 in accordance with this disclosure. The autofill pitcher system 140 is illustrated on the left door 126 for convenience. In other embodiments, the autofill pitcher system 140 may be in a different position on the left door 126, or on the right door 128, or elsewhere within the fresh food chamber 122.

Figure 3:
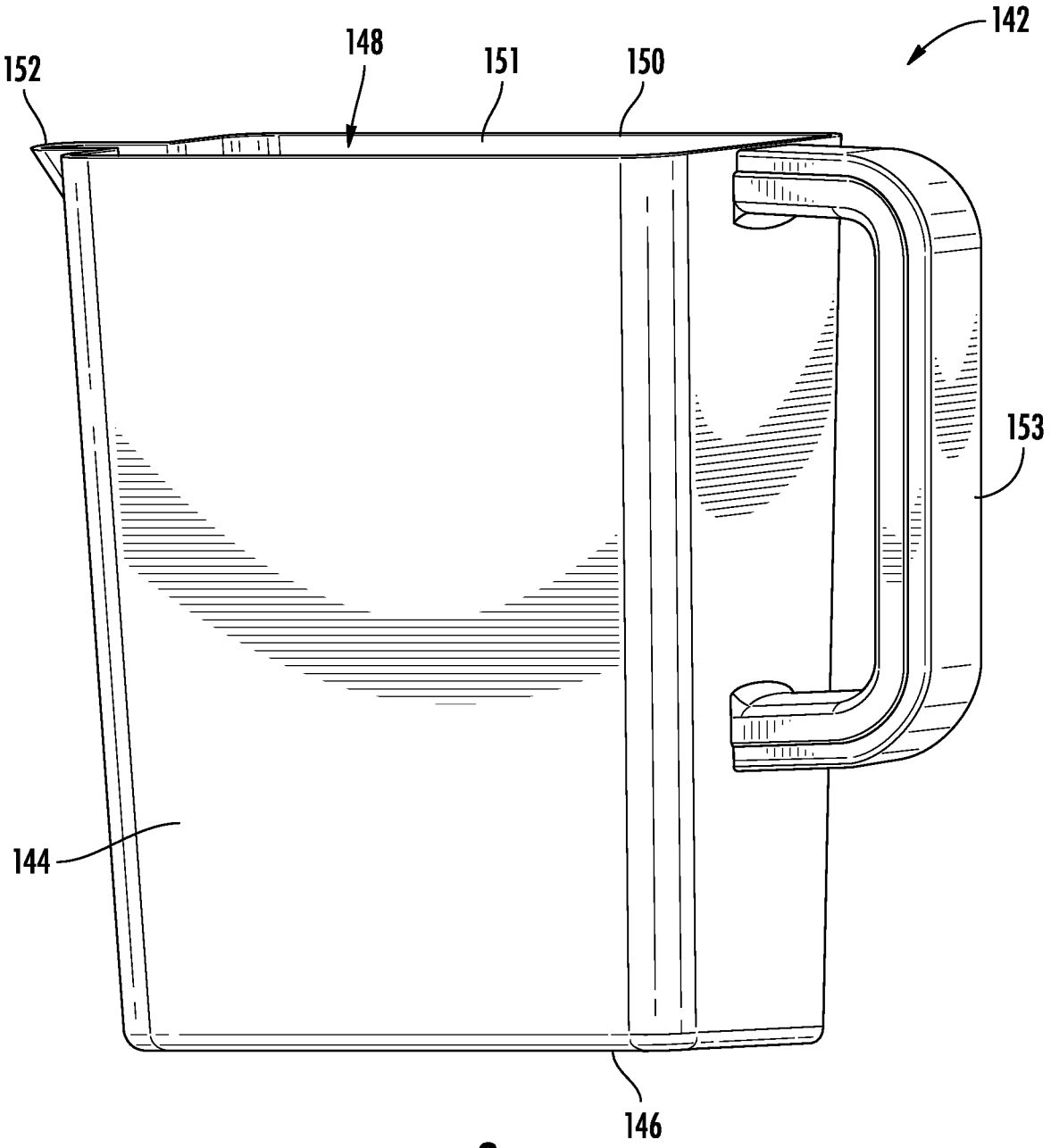
FIG. 3 provides a perspective view of a pitcher in accordance with an embodiment of the present disclosure.

The autofill pitcher system 140 comprises a removable pitcher, pitcher 142, a dispenser 180, and controller 200. The details of exemplary pitcher 142 may best be illustrated with reference to FIGS. 3 and 4. FIG. 3 is a perspective view of a representative pitcher 142 comprising a pitcher wall 144 connected to, or formed with, pitcher bottom 146. A top edge 150 is formed by the pitcher wall 144 at the pitcher end opposite pitcher bottom 146. The pitcher wall 144 and pitcher bottom define a pitcher volume 148, accessible through opening 151 defined by the top edge 150. For convenience, top edge 150 may also define a spout 152 at a first end of the pitcher to facilitate directing liquid into, or out of, the pitcher 142. At a second end of the pitcher, opposite the spout 152, a handle 153 may be included to provide a gripping area to aid in manipulating the pitcher 142.

Exemplary pitcher 142 is illustrated as a generally hollow rectangular cuboid for ease of illustration only. Other embodiments may have other shapes, for example a hollow cylinder, and may or may not have features such as a spout or a handle.

Figure 4:
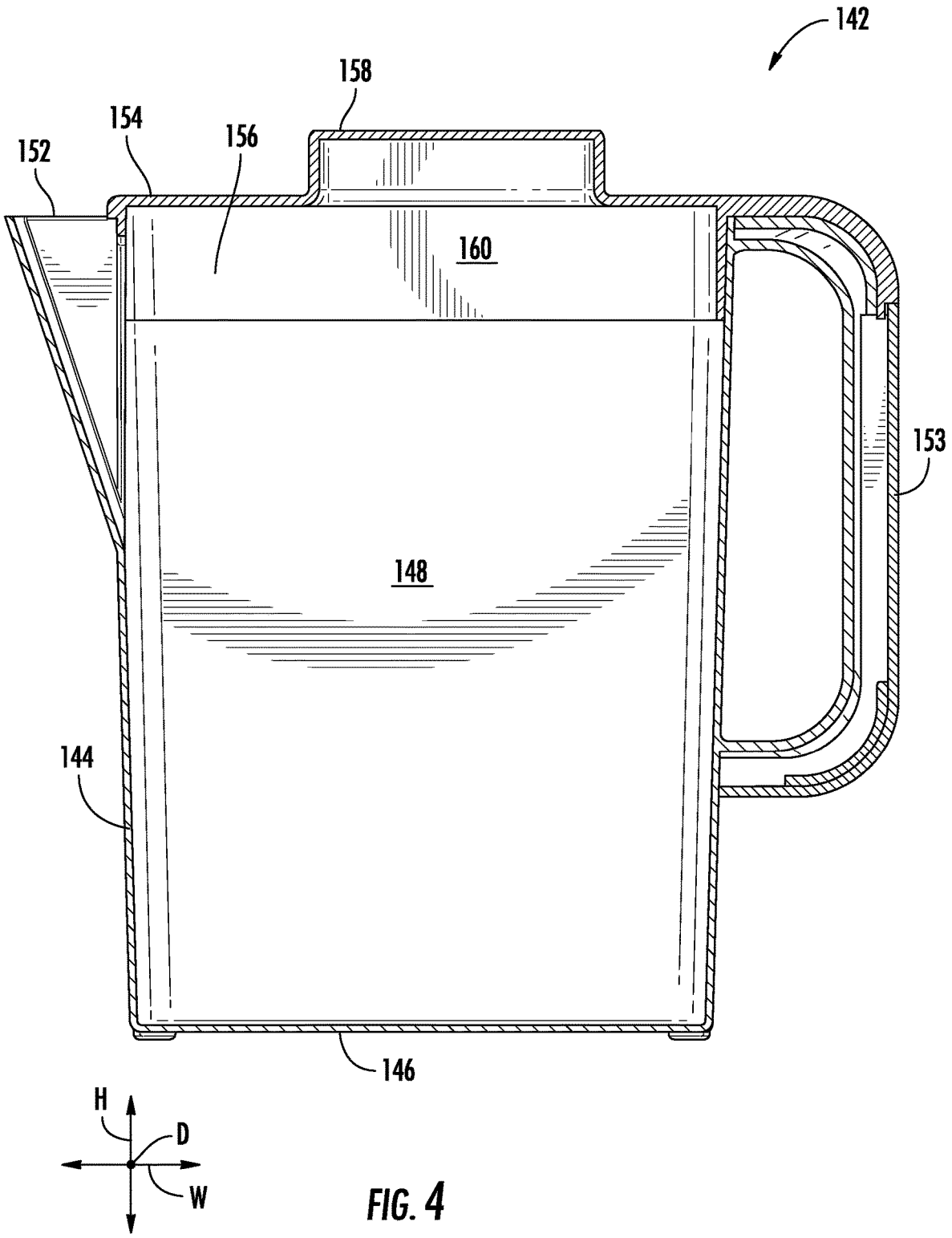
FIG. 4 provides a side sectional view of a pitcher and lid in accordance with an embodiment of the present disclosure.

An orthogonal coordinate system for the embodiment of water pitcher 142 is defined in FIG. 4. The height H is generally parallel to the vertical direction V used in reference to the refrigerator appliance 100 in FIGS. 1 and 2. Width W extends perpendicular to the height H from the spout end to the handle end of the pitcher 142. The depth D is perpendicular to the H-W plane.

As illustrated in FIG. 4, embodiments of pitcher 142 may include a lid 154 removably received in the opening 151 at the top edge 150. The lid 154 may include a peripheral skirt 156 configured to be removably received in the opening 151 of pitcher 142. Some embodiments of the skirt 156 may include features (not shown) that engage an inner portion of pitcher wall 144 at the top edge 150 to secure the lid against accidental separation from the pitcher 142.

Figure 5:
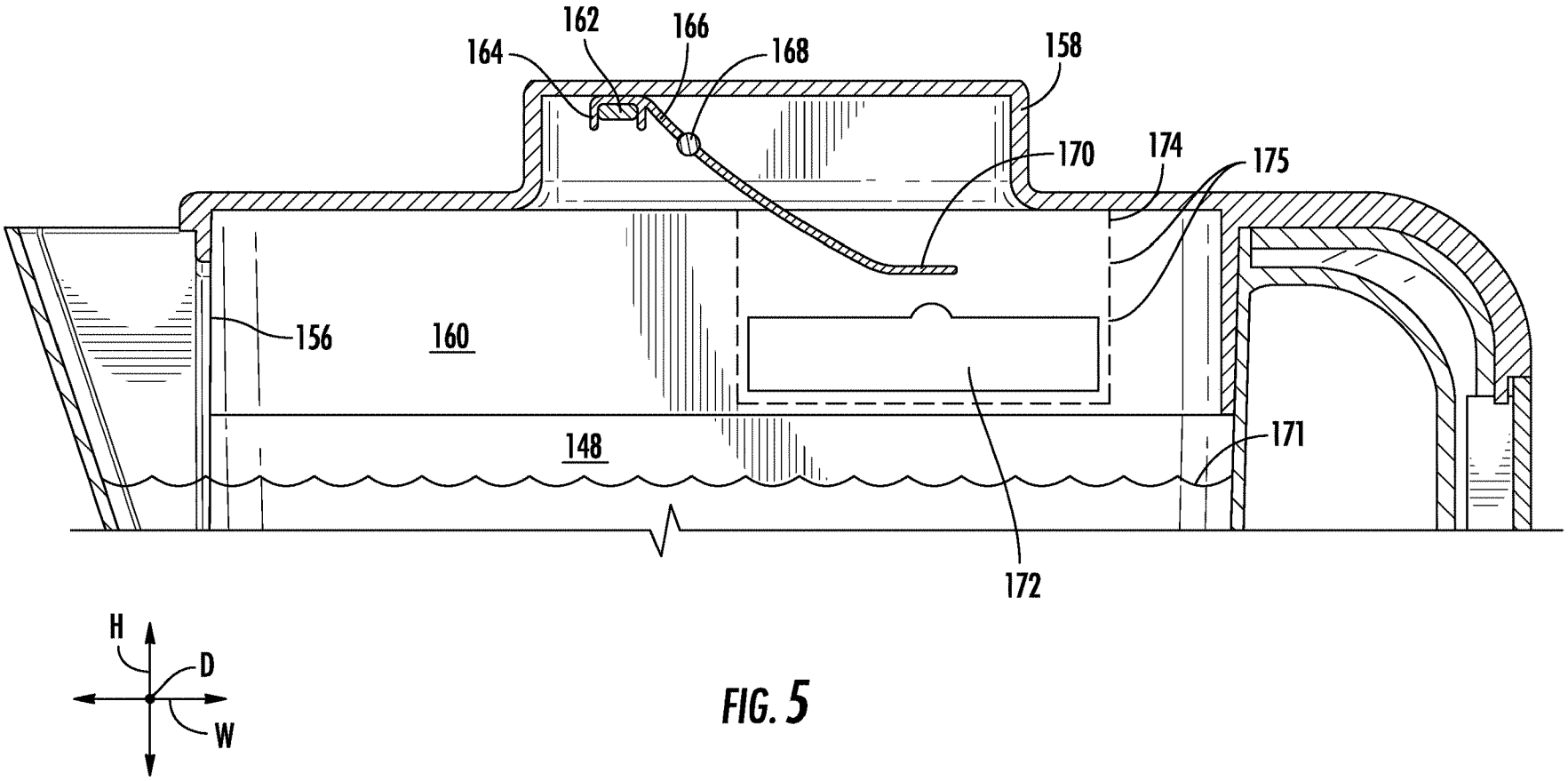
FIG. 5 provides an enlarged view of an upper portion of a pitcher with a lid and an overfill shutoff mechanism in a first position in accordance with an embodiment of the present disclosure.

Lid 154 may include a top wall 158 joined to, or formed with, the skirt 156 such that the skirt 156 and top wall 158 define a cavity or volume 160 in the lid 154. As illustrated in FIG. 5, embodiments of the present disclosure include a first magnet 162 adjacent to the top wall 158 of the lid 154. First magnet 162 may be fixed to the first end 164 of pivot arm 166. Pivot arm 166 is pinned for rotation at 168 about an axis generally parallel to the depth D of FIG. 4. The pivot arm 166 is configured such that, when pinned at 168, the first end 164 with the first magnet 162 is urged in a first position against the top wall 158. For example, the effect of the weight of the second end 170 of pivot arm 166 causes the pivot arm 166 to rotate about pivot 168 in a clockwise direction as illustrated in FIG. 5. As will be discussed in greater detail below, when the pivot arm 166 is in the first position, the first magnet 162 is recognized by a detection sensor.

In embodiments, the lid 154 also includes a first float body 172 located below the second end 170 of pivot arm 166 and constrained to allow movement in the H direction. For example, a float basket 174 with a plurality of perforations 175 may limit the movement of first float body 172 to the H direction. When the fluid level 171 in the pitcher volume 148 is below the float basket 174 as in the under-filled condition as illustrated in FIG. 5, the first float body 172 has no effect on the pivot arm 166 or the first magnet 162.

Figure 6:
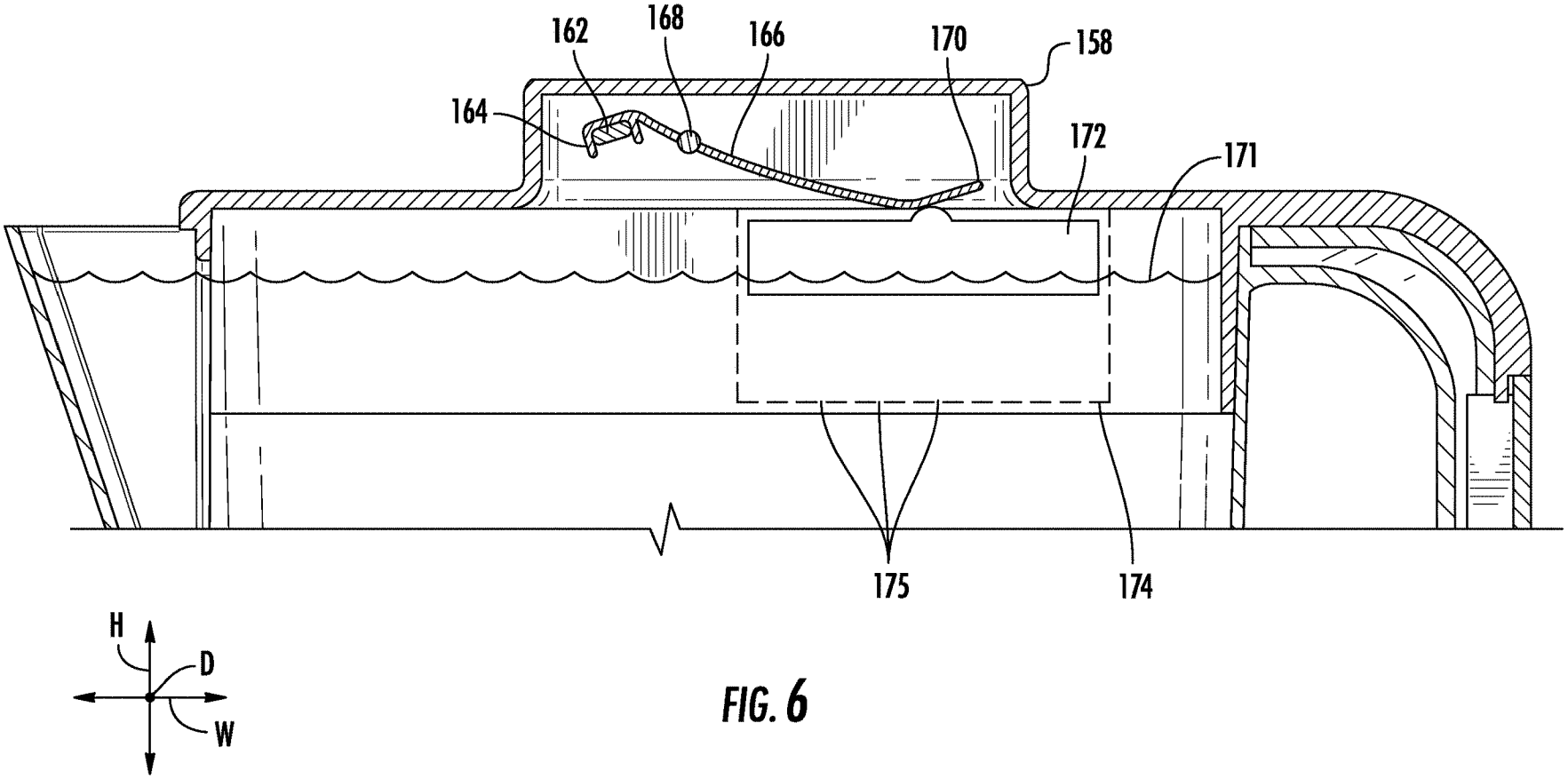
FIG. 6 provides a view of the overfill shutoff mechanism of FIG. 5 in a second position in accordance with an embodiment of the present disclosure.

In an over-fill condition as illustrated in FIG. 6, the perforations 175 allow liquid from the pitcher volume 148 to flow into the float basket 174. The fluid level 171 lifts the first float body 172 upward in the H direction. The first float body 172 contact the second end of the pivot arm 166, causing the pivot arm 166 to rotate (counterclockwise as illustrated) into the second position. As illustrated in FIG. 6, in the second position, the first end 164 of the pivot arm 166 moves away from the top wall 158 and consequently, the first magnet also moves away from the top wall 158.

Dispenser 180 defines a cavity 181 to receive the removable pitcher 142 with the H direction generally parallel to the vertical direction V of the refrigerator appliance 100. In the illustrative embodiment shown in the figures, the dispenser 180 is positioned on the inner surface 134 of left door 126 of the refrigerator appliance 100. Other embodiments may have the dispenser on other doors or elsewhere in the fresh food chamber 122. As illustrated, the cavity 181 comprises a support or shelf 108 to support the pitcher 142 in the vertical direction V and a sensor board 188 adjacent to the lid 154 of the pitcher 142. Other features (not shown) may be provided to secure the pitcher 142 in the cavity 181 during filling and as the door 126 is open and closed to provide access to the fresh food chamber.

The dispenser 180 may include a fill tube 184 adapted to direct water from a water supply to the pitcher 142. A valve 186 may be provided in line with the fill tube 184 between the water supply and the pitcher 142 to selectively allow the flow of water to the pitcher 142. The valve is operatively coupled to the controller 200.

The sensor board 188 includes a first sensor 182 secured in the board and adjacent positioned to detect the first magnet 162 in the pitcher 142 when the pitcher is present and properly located in the cavity 181. The first sensor 182 may be any type of sensor capable of detecting the first magnet and providing a pitcher present signal to a controller 200. Controller 200 is operatively coupled to the sensor board 188 and first sensor 182 to interpret the pitcher present signal from the first sensor.

Controller 200 controls the operation of the autofill pitcher system in that it interprets signals received from various sensors of the dispenser 180 and determines if the autofill operation should initiate and when it should stop. Controller may include control circuits, a memory, and microprocessor, such as a general purpose or special purpose microprocessor operable to execute programming instructions or micro-control code associated with the operation of the autofill pitcher system. Alternatively, controller 200 may be constructed without using a microprocessor, e.g., using a combination of discrete analog or digital logic circuitry to perform control functionality instead of relying on software.

The controller 200 maintains the valve 186 in the closed position until a pitcher present signal is received from the first sensor 182 indicating that the pitcher is in the proper position for the autofilling. The pitcher present signal is sent when the pivot arm 166 in the pitcher 142 is in the first position and the first magnet 162 is in position to be sensed by the first sensor 182. As discussed above, in the first position first float body 172 has no effect on pivot arm 166 or the position of first magnet 162. The first float body 172 is in a lower position indicating that the pitcher is in a normal condition (i.e., not over-filled with water) and water may be dispensed by the dispenser 180 to provide the maximum volume of water in the pitcher 142.

Figure 7:
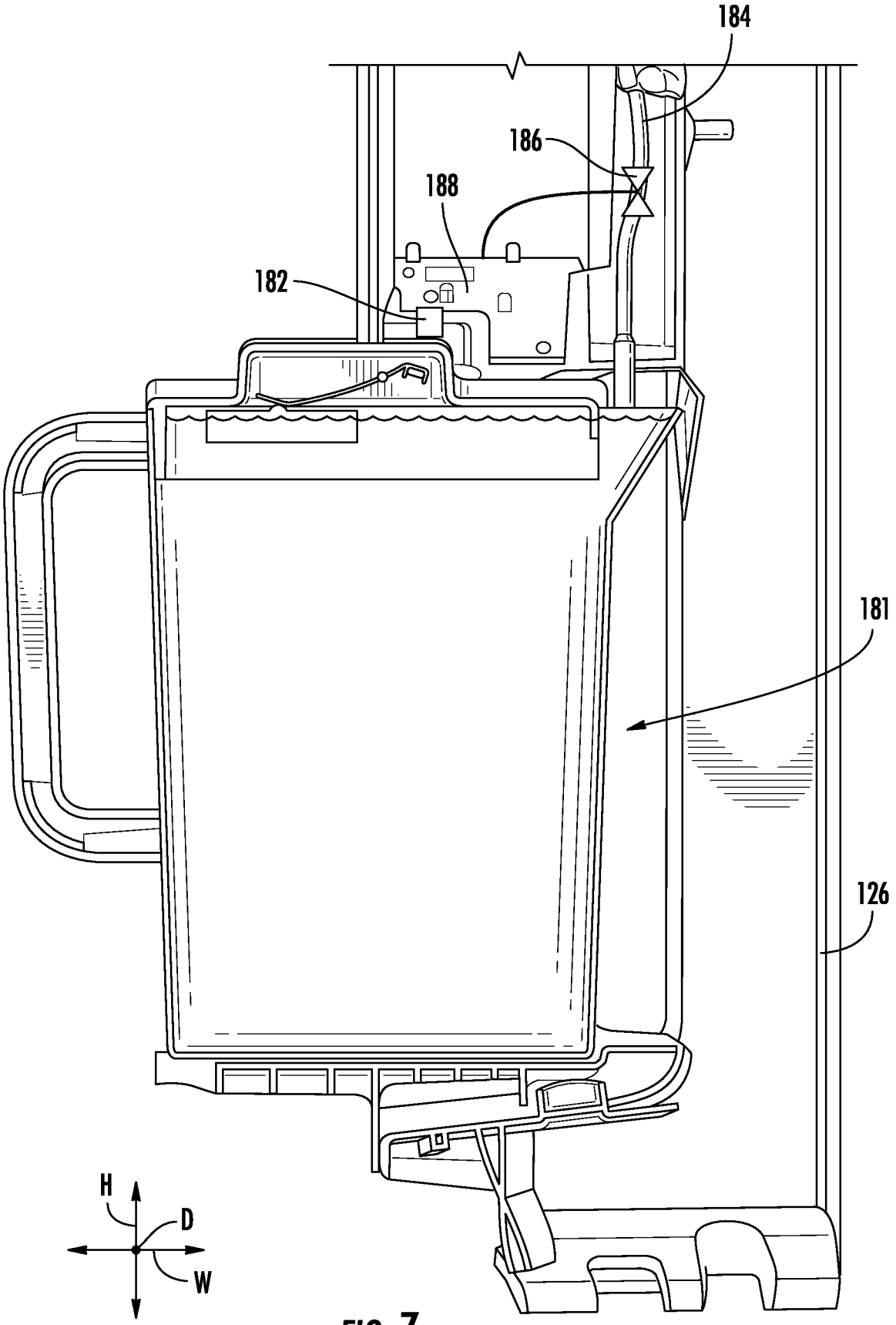
FIG. 7 provides an illustrative view of a pitcher received in a dispenser cavity in accordance with an embodiment of the present disclosure.

Upon receiving the pitcher present signal from the first sensor, controller 200 may signal valve 186 to allow water to flow into the pitcher 142. In the exemplary embodiment illustrated in FIG. 7, the fill tube 184 is positioned directly above the spout 152 of the pitcher 142. In other embodiments, the fill tube 184 may be in other locations suitable to allow the flow of water into the pitcher volume 148. Water flow to the pitcher continues until the first sensor 182 fails to send a pitcher present signal to the controller 200. This may occur when the pitcher 142 is removed from the cavity 181 or when the first float body 172 is urged upward against the second end 170 of the pivot arm 166, rotating the pivot arm 166 to the second position (FIG. 7). In either case, when the pitcher present signal to the controller 200 is interrupted, controller 200 signals the valve 186 to close, stopping the flow of water to the pitcher 142.

Figure 8:
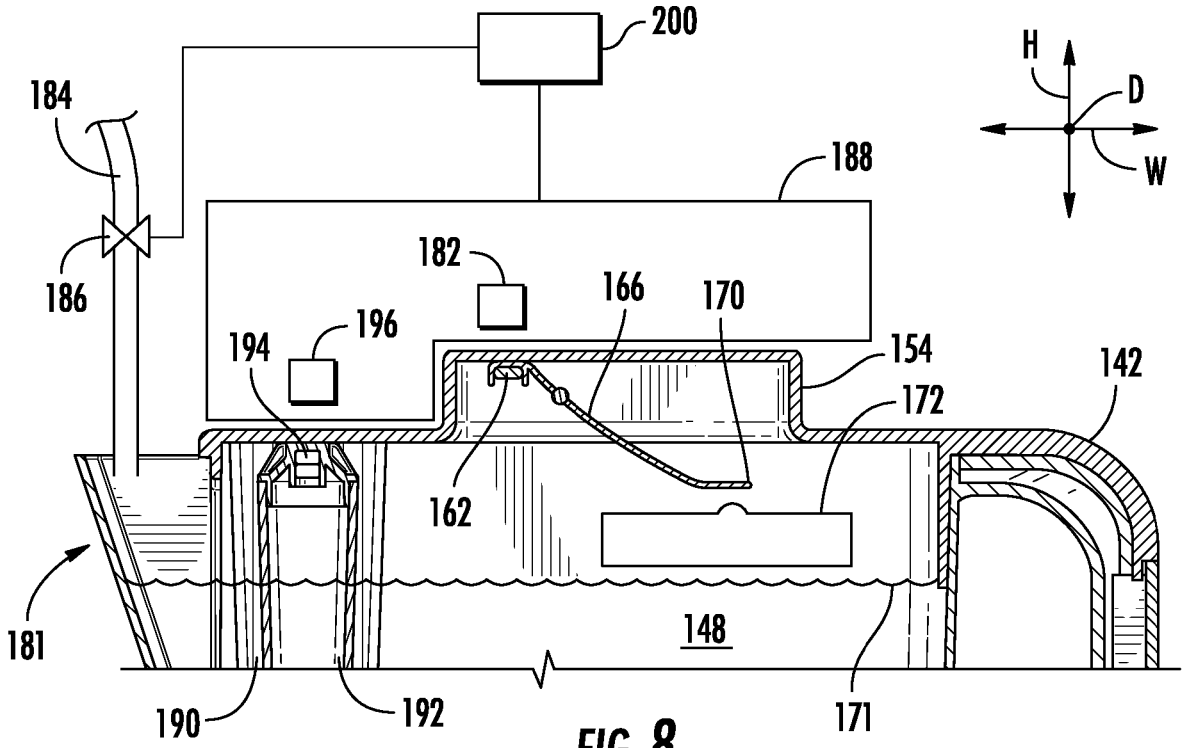
FIG. 8 provides an enlarged view of an upper portion of a pitcher with a lid and an overfill shutoff mechanism in a first position in accordance with an embodiment of the present disclosure.
Figure 9:
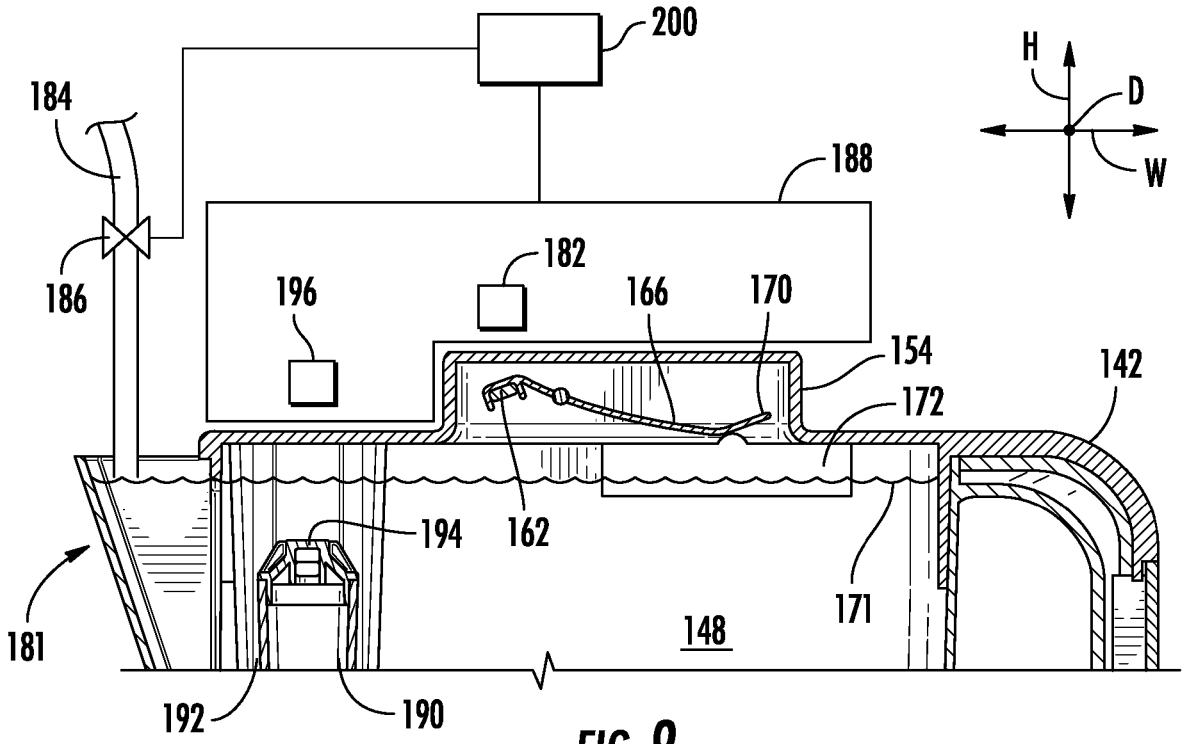
FIG. 9 a view of the overfill shutoff mechanism of FIG. 5 in a second position in accordance with an embodiment of the present disclosure.

In the illustrative embodiment discussed above, one magnet/sensor pair, first magnet 162 and first sensor 182, provided both the pitcher present signal and the normal water level signal to the controller 200. In some cases it may be advantageous to have a pitcher present sensor, a water level sensor, and an over-fill sensor as a redundant water control system. In the embodiment of FIGS. 8 and 9, such an autofill pitcher system is illustrated, with the pitcher present sensor and the over-fill sensor combined.

FIGS. 8 and 9 illustrate an upper portion of a pitcher 142 received in a cavity 181 in dispenser 180 in accordance with an embodiment of this disclosure. The pitcher 142 includes lid 154, first magnet 162, second magnet 194, pivot arm 166, and first float body 172. Dispenser 180 comprises a first sensor 182, a second sensor 196, a fill tube 184, and a valve 186 in line with the fill tube 184.

In FIGS. 8 and 9, lid 154 is substantially similar in construction as discussed above with the addition of channel 190 affixed to, or formed with, lid 154. Channel 190 is generally cylindrical in shape with the axis parallel to the H direction. The wall of the cylindrical channel 190 may be perforated or sections removed to allow water from the pitcher volume 148 to freely enter the channel 190.

Second float body 192 is a generally cylindrical body disposed inside channel 190 constrained to allow displacement in the H direction (i.e., parallel to V). The upper end of the second float body 192 includes a second magnet 194 fixed to a first end of second float body 192.

As illustrated in FIG. 8, pitcher 142 is filled with an amount of water to a fluid level 171. Pivot arm 166 is in the first position placing first magnet 162 and first sensor 182 in close proximity and signaling controller 200 that the pitcher 142 is present and properly received in the cavity 181. The pitcher present signal to controller 200 also indicates that dispenser 180 may dispense water to the pitcher, if necessary, as determined by second magnet 194 and second sensor 196.

In FIG. 8, second float body 192 has been buoyed up with the fluid level 171 and second magnet 194 is in close proximity with second sensor 196, signaling controller 200 that the pitcher is filled. Controller 200 interprets the signal from the second sensor 196 and signals valve 186 to stop the flow of water to the pitcher 142.

FIG. 9 is illustrative of an overfill situation in which the valve 186 failed to receive a pitcher full signal from controller 200 and continued to dispense water into the pitcher volume 148. Fluid level 171 exceeded the desired fill level, raising first float body 172 upwards in the H direction. First float body 172 contacted second end 170 of pivot arm 166, causing pivot arm 166 to rotate to the second position as illustrated in FIG. 9. In the second position, the first magnet 162 is rotated away from first sensor 182. This sends a signal to the controller 200 that the pitcher is not present and water should not be dispensed. Controller 200 signals the valve 186 to close and the flow of water to the pitcher 142 is interrupted before the pitcher overflows.

It will be appreciated that the present subject matter can be used with other types of refrigerator appliances as well, such as e.g., top mount, or top freezer, refrigerator appliances or single door refrigerators. Consequently, the description set forth herein is not intended to limit the present subject matter in any aspect.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A refrigerator appliance comprising:
- a cabinet defining a fresh food chamber;
- an autofill pitcher system comprising:
  - a removable pitcher comprising:
    - a pitcher wall connected to a pitcher bottom defining a volume, the pitcher wall defining an opening at a top edge of the removable pitcher; and
    - a first magnet fixed to a first end of a pivot arm, the pivot arm pinned for rotation between a first position and a second position;
  - a dispenser defining a cavity within the fresh food chamber to receive the removable pitcher, the dispenser comprising:
    - a first sensor;
    - a fill tube adapted to direct water from a water supply to the removable pitcher;
    - a valve coupled to the fill tube; and
  - a controller configured to open the valve when the first sensor detects the first magnet when the pivot arm is in the first position and close the valve when the first sensor does not detect the first magnet in the second position.

2. The refrigerator appliance of claim 1, wherein the removable pitcher further comprises a lid removably fitted to the opening of the removable pitcher, wherein the pivot arm is pinned to the lid for rotation and the first magnet is urged against an underside of the lid when the pivot arm is in the first position.

3. The refrigerator appliance of claim 2, wherein the pivot arm is arranged such that a second end of the pivot arm is heavier than the first end thereby urging the pivot arm into the first position.

4. The refrigerator appliance of claim 3, further comprising a first float body constrained within the lid and vertically below the second end of the pivot arm when a water level in the removable pitcher is below a certain level.

5. The refrigerator appliance of claim 4, wherein the first float body floats on a surface of the water in the removable pitcher when the water level is above a certain level such that the first float body urges the second end of the pivot arm vertically upward, causing the pivot arm to rotate to the second position.

6. An autofill pitcher system comprising:
a removable pitcher including:
a pitcher wall connected to a pitcher bottom defining a volume, the pitcher wall defining an opening at a top edge of the removable pitcher; and
a first magnet fixed to a first end of a pivot arm, the pivot arm pinned for rotation between a first position and a second position;
a dispenser defining a cavity to receive the removable pitcher, the dispenser comprising:
a first sensor;
a fill tube adapted to direct water from a water supply to the removable pitcher;
a valve coupled to the fill tube; and
a controller configured to open the valve when the first sensor detects the first magnet when the pivot arm is in the first position and close the valve when the first sensor does not detect the first magnet in the second position.

7. The autofill pitcher system of claim 6 further comprising a lid removably fitted to the opening of the removable pitcher, wherein the pivot arm is pinned for rotation to the lid and the first magnet is urged against an underside of the lid when the pivot arm is in the first position.

8. The autofill pitcher system of claim 7, wherein the pivot arm is arranged such that a second end of the pivot arm is heavier than the first end thereby urging the pivot arm into the first position.

9. The autofill pitcher system of claim 8, further comprising a first float body constrained within the lid and vertically below the second end of the pivot arm when a water level in the removable pitcher is below a certain level.

10. The autofill pitcher system of claim 9, wherein the first float body floats on a surface of the water in the removable pitcher when the water level is above a certain level such that the first float body urges the second end of the pivot arm vertically upward, causing the pivot arm to rotate to the second position.

11. An autofill pitcher system comprising:
a removable pitcher including:
a pitcher wall connected to a pitcher bottom defining a volume, the pitcher wall defining an opening at a top edge of the removable pitcher; and
a first magnet fixed to a first end of a pivot arm, the pivot arm pinned for rotation between a first position and a second position;
a second magnet;
a dispenser defining a cavity to receive the removable pitcher, the dispenser comprising:
a first sensor;
a second sensor;
a fill tube adapted to direct water from a water supply to the removable pitcher;
a valve coupled to the fill tube;
wherein a pitcher present signal is sent to a controller when the first sensor detects the first magnet; and
the controller sends a signal to open the valve when the second sensor does not detect the second magnet.

12. The autofill system of claim 11, further comprising a lid removably fitted to the opening of the removable pitcher, wherein the pivot arm is pinned to the lid for rotation and the first magnet is urged against an underside of the lid when the pivot arm is in the first position.

13. The autofill system of claim 12, wherein the pivot arm is arranged such that a second end of the pivot arm is heavier than the first end, thereby urging the pivot arm into the first position.

14. The autofill system of claim 13, further comprising a first float body constrained within the lid and vertically below a second end of the pivot arm when a water level in the removable pitcher is below a certain level.

15. The autofill system of claim 14, further comprising a second float body constrained within the lid and vertically below an underside of the lid when a water level in the removable pitcher is below a certain level.

16. The autofill pitcher system of claim 15, wherein the second magnet is fixed to a first end of the second float body.

17. The autofill pitcher system of claim 15, wherein, when the water level in the removable pitcher exceeds a certain level, the second sensor detects the second magnet and the controller sends a signal to the valve to stop a flow of water to the removable pitcher.

18. The autofill pitcher system or claim 11, wherein the controller sends a signal to the valve to stop a flow of water to the removable pitcher when the first sensor fails to detect the first magnet.

* * * * *